United States Patent [19]

Landa

[11] 4,350,447

[45] Sep. 21, 1982

[54] SYNCHRONIZING SYSTEM FOR RAPID-FIRE GUN IN A MICROBALLISTIC PRINTER OR THE LIKE

[75] Inventor: Benzion Landa, Alberta, Canada

[73] Assignee: Savin Corporation, Valhalla, N.Y.

[21] Appl. No.: 304,781

[22] Filed: Sep. 23, 1981

Related U.S. Application Data

[63] Continuation of Ser. No. 85,688, Oct. 17, 1979, abandoned.

[51] Int. Cl.[3] ..... B41J 3/02

[52] U.S. Cl. ..... 400/118; 400/121

[58] Field of Search ..... 400/118, 119, 121, 126; 346/75; 89/135

[56] References Cited

U.S. PATENT DOCUMENTS

| | | | |
|---|---|---|---|
| 3,695,246 | 10/1972 | Filippi et al. | 124/72 |
| 3,769,627 | 10/1973 | Stone | 346/75 |
| 3,810,194 | 5/1974 | Tokunaga et al. | 346/75 |
| 3,848,509 | 11/1974 | Corn | 89/41 SW X |
| 3,893,126 | 7/1975 | Ascoli et al. | 346/1.1 |
| 4,046,131 | 9/1977 | Clark et al. | 124/71 |
| 4,124,849 | 11/1978 | Zahornasky et al. | 89/41 SW X |
| 4,149,807 | 4/1979 | Avison et al. | 400/126 X |
| 4,150,902 | 4/1979 | Brescia | 400/126 X |

*Primary Examiner*—Paul T. Sewell

*Attorney, Agent, or Firm*—Shenier & O'Connor

[57] ABSTRACT

Apparatus for synchronizing the aiming and firing of the solid projectile gun of a microballistic printer or the like. In the preferred embodiment, a microphone acoustically coupled to an inlet used to supply pressurized air to the ball gun senses the pressure drop occurring in the ball gun pressure chamber when a ball is fired. The microphone output is used by the ball gun control system to determine when the ball has left the ball gun, allowing the ball gun to be redirected at a new target location. In alternative embodiments of the invention, a microphone disposed adjacent the muzzle of the ball gun and an optical detector are respectively used to sense when a ball has been fired.

13 Claims, 6 Drawing Figures

10
12
14
16
18
20
22
24
26
28
30
32
34
36
44
46
48
50
52
56
58
60
62
64
66
68
70
72
74
76
78
80
82
84
86
87
88
90
92
94
96
98
100
102
X
Y
2
2

SYNCHRONIZING SYSTEM FOR RAPID-FIRE GUN IN A MICROBALLISTIC PRINTER OR THE LIKE

This is a continuation of application Ser. No. 85,688, filed Oct. 17, 1979, abandoned.

BACKGROUND OF THE INVENTION

This application relates to apparatus for synchronizing the aiming and firing of the rapid-fire gun of a microballistic printer or the like.

In copending application Ser. No. 39,372, filed May 15, 1979, I describe a printer which directs a plurality of solid projectiles such as balls about one millimeter in diameter in extremely rapid succession against a printing medium such as a ribbon overlying a sheet of paper. In the gun of the printer, which is movable about orthogonal axes for targeting, balls are introduced successively into a resilient breech which is slightly smaller in diameter than the balls and behind which air is maintained under pressure. The ball is fired by pushing it sufficiently far into the breech to snap the ball through to the barrel side and allow the pressurized air to expand into the barrel and propel the ball outwardly.

In the ballistic printer disclosed in my copending application, it is extremely important that the aiming of the ball gun and the firing of projectiles therefrom be accurately synchronized relative to each other. If the ball gun is moved while a ball is traversing the barrel, the trajectory of the ball is disturbed in an unpredictable manner, causing the ball to strike the medium widely off target. If the aiming and firing steps are poorly synchronized or performed asynchronously, a significant number of balls will miss their mark, giving the sheet a speckled, aesthetically displeasing appearance.

In the previously disclosed ballistic printer, the synchronizing signal is obtained from a disc which rotates on a common shaft with a rotary saw blade used to inject the balls into the ball gun. The disc is formed with a plurality of equidistantly spaced apertures around its periphery equal in number to the teeth on the saw blade. A stationary photodetector disposed adjacent the periphery of the disc generates the synchronizing pulse. Accuracy of synchronization in a system of this type depends, of course, on the registry of the disc apertures with the teeth of the saw blade, which may be difficult to achieve reliably. In such a system, moreover, one is detecting only that a projectile should have been fired, rather than the event that a projectile actually has been fired.

SUMMARY OF THE INVENTION

One of the objects of my invention is to provide a ballistic printer which accurately directs projectiles against a printing medium.

Another object of my invention is to provide a ballistic printer which accurately synchronizes the aiming and firing of the print projectiles.

Still another object of my invention is to provide a ballistic printer which is capable of high-speed operation.

A further object of my invention is to provide a ballistic printer which is simple and inexpensive.

Other and further objects of my invention will be apparent from the following description.

In general, my invention contemplates apparatus fo synchronizing the aiming and firing of the gun of a microballistic printer in which a suitable sensor, such as a microphone, is used to detect the firing of a ball or other projectile by the ball gun. The output of the firing sensor is in turn used by the ball gun control system to determine when the ball has left the muzzle of the ball gun, allowing the ball gun to be aimed at a new target location. In the preferred form of my invention, the firing sensor comprises a microphone acoustically coupled to the air inlet supplying pressurized air to the pressure chamber of the ball gun. Alternatively, the firing sensor may comprise a microphone or an optical detector disposed adjacent the muzzle of the gun. By controlling the aiming of the ball gun in response to the actual firing of a projectile therefrom, I am able to achieve accurate synchronization of the aiming and firing steps, thereby permitting high-speed firing operation while retaining aiming accuracy.

BRIEF DESCRIPTION OF THE DRAWINGS

In the accompanying drawings to which reference is made in the instant specification and in which like reference characters are used to indicate like parts in the various views.

DETAILED DESCRIPTION OF THE PREFERRED EMBODIMENTS

Figures 1, 2:
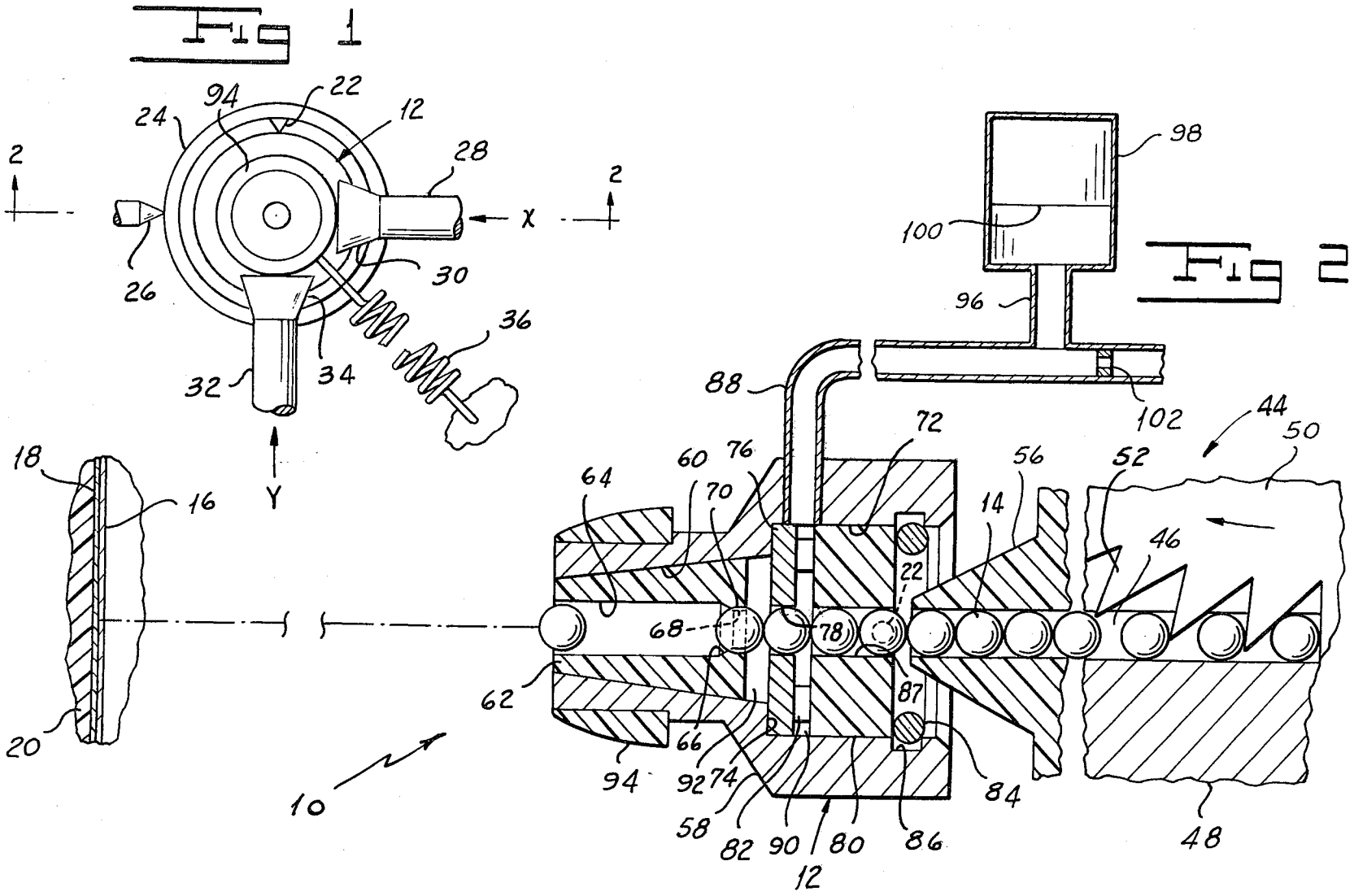
FIG. 1 is a fragmentary front elevation of the gun and associated positioning assembly of my ballistic printer with the gun in a neutral position.
FIG. 2 is a fragmentary section of the ball gun and ball injector of my ballistic printer, taken along line 2—2 of FIG. 1.

Referring now to FIGS. 1 and 2, in one embodiment of my printer, indicated generally by the reference numeral 10, a gun indicated generally by the reference numeral 12 is arranged to direct a plurality of projectiles such as balls 14 successively against a ribbon 16 overlying a sheet of paper 18 on a platen 20. Balls 14 may be, for example, 0.8 mm diameter so as to produce a spot size on the paper of 0.3 mm diameter. A pair of vertical pivots 22 carried by a ring 24 support ball gun 12 for movement about a vertical pivot axis, while a pair of fixed horizontal pivots 26 suport ring 24, and hence the ball gun 12, for movement about a horizontal pivot axis. Ball gun 12 is thus capable of being independently pivoted around the X, or horizontal, axis and around the Y, or vertical, axis to direct successively fired balls 14 against desired impact points on the ribbon 16.

Figure 3:
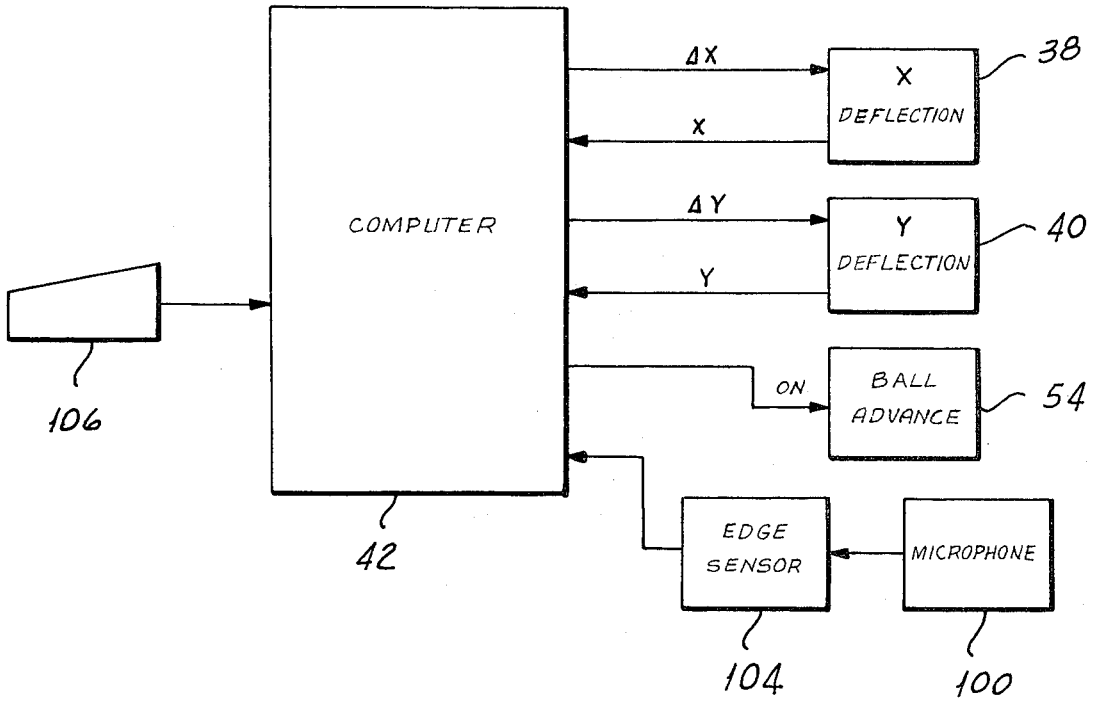
FIG. 3 is a schematic diagram of the control circuit for the ball gun shown in FIG. 1.

A deflection rod 28 moved in the direction of the X axis by an X actuator unit 38 shown schematically in FIG. 3 bears with its head 30 against a portion of the ball gun 12 disposed forwardly of the vertical pivot axis to pivot it through the desired angle around the Y axis. Similarly, a Y deflection rod 32 moved in the direction of the Y axis by a Y actuator unit 40 shown schematically in FIG. 3 bears with its head 34 against a portion of the ball gun 12 disposed forwardly of the horizontal pivot axis to pivot it through the desired angle in the Y direction. A tension spring 36 maintains ball gun 12 in intimate contact with the actuator heads 30 and 34.

Referring now to FIG. 3, actuators 38 and 40 are controlled by a computer 42 of any suitable type, such as an Intel 8048 or other microcomputer, associated with the printer 10. Units 38 and 40 supply position signals X and Y representing the instantaneous displacement of the rods 28 and 32 to the computer 42, which in turn supplies correction signals ΔX and ΔY to move the rods 28 and 32 to new positions if different from the current positions. The construction and operation of the actuator units 38 and 40, while in themselves forming no part of the present invention, are described in detail in my copending application Ser. No. 39,372.

Referring again to FIG. 2, in the ball injector of my printer 10, indicated generally by the reference numeral 44, a rotary saw blade 50 provided with teeth 52 guides balls 14 to be fired to the left as viewed in the figure along a channel 46 formed in a guide 48. A ball advance motor 54 indicated schematically in FIG. 3 drives saw blade 50 clockwise in response to a ball advance signal from computer 42. Balls 14 driven along channel 46 in this manner enter a second guide 56 which injects them into the rear of the ball gun 12, as will be described in more detail below.

Gun 12 includes a body 58 having a conical bore 60 which receives the gun barrel 62. The gun barrel 62, which is formed of a suitable resilient material, has an outer conical surface conforming to the conical bore 60 so that the barrel is self-locating in the housing or body 58. Barrel 62 has a length of about 3 mm in the embodiment shown and is formed with an inner cylindrical bore 64 of a diameter which is slightly greater than that of the balls 14. Bore 64 extends from the front of the barrel rearwardly toward a tapered portion 66 leading into a cylindrical sphincter or breech 70, having an opening 68 with a normal diameter, shown in dotted lines in FIG. 2, slightly less than that of the balls 14.

A recess 72 in the body 58 behind the conical bore 60 receives a loading guide 76 which bears against a shoulder 74 at the juncture between bore 60 and recess 72. Guide 76 has a central opening 78 of a diameter which is slightly greater than that of a ball 14 by, for example, 0.01 mm. I position a pressure seal 80 within recess 72 behind guide 76 and spaced therefrom by spacers 82. A spring clip 84 disposed in an annular recess 86 holds the pressure seal in position. I form the seal 80 with a central passage 87 having a diameter substantially equal to the diameter of a ball 14, which passage 87 leads from the outlet of guide 56 and is aligned with the opening 78 in guide 76. An air inlet 88 admits air under a pressure of 4 to 6 atmospheres through the wall of body 58 to the antechamber 90 between guide 76 and seal 80. The arrangement of my gun assembly is such that the rear of barrel 62 is spaced from guide 76 to form a pressure chamber 92.

I assemble a designator cam 94 of the assembly 12 on a reduced forward end portion of the main body 58 of the gun. Cam 94 is so formed as to provide a surface contour on which actuator heads 30 and 34 ride.

Figure 6:
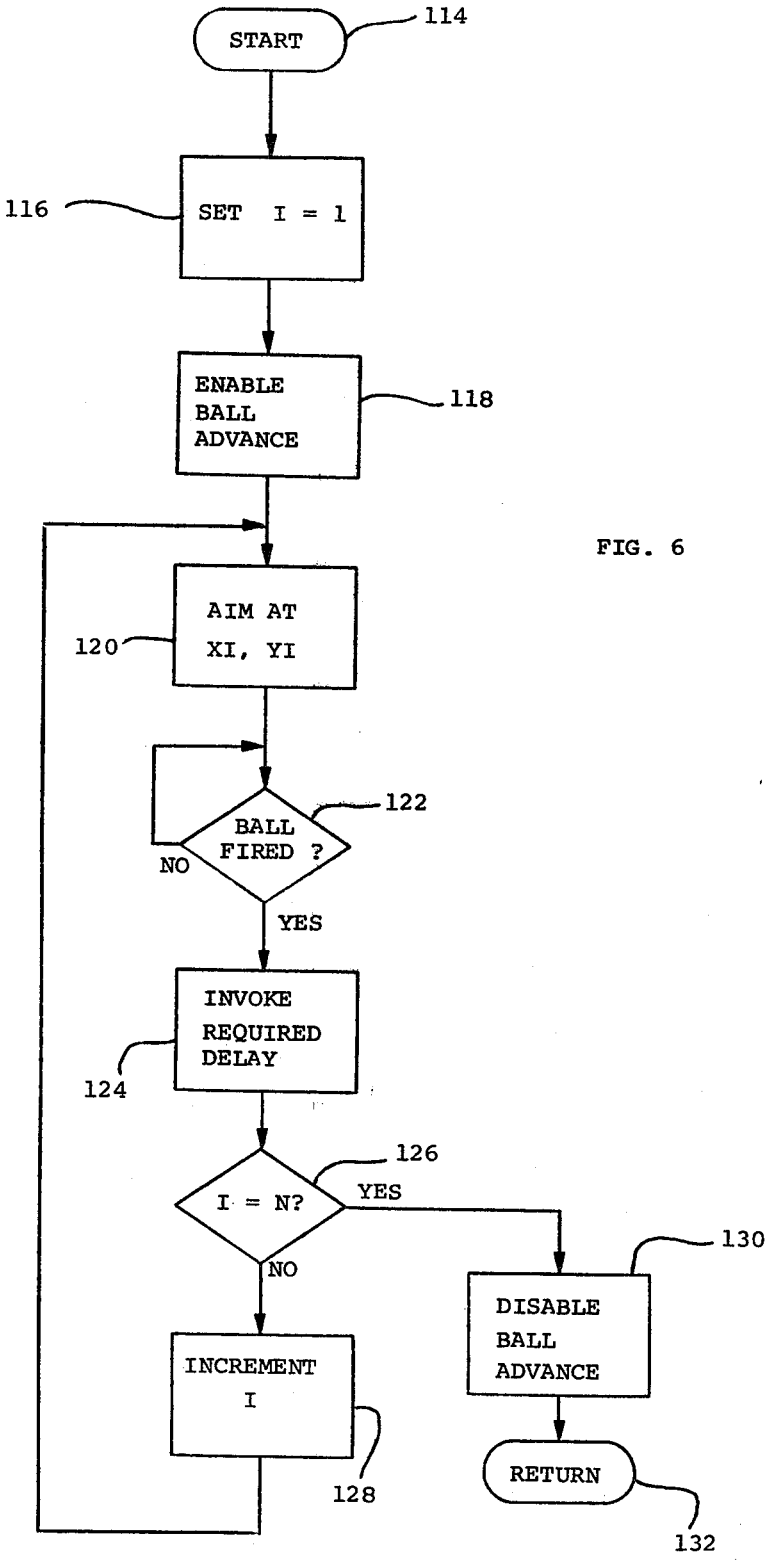
FIG. 6 is a flowchart of a control subroutine used by the circuit shown in FIG. 3.

Computer 42 is programmed in a manner known to those skilled in the art to follow a subroutine such as shown in FIG. 6 for successively directing N balls 14 against the ribbon 16 at respective locations (X1, Y1) through (XN, YN). Such a subroutine may, for example be entered to print a particular stroke of a character supplied to the computer by an input device such as a keyboard 106. After entering the subroutine (block 114), the program first initializes the index I at 1 (block 116). Next, the program enables the ball advance motor 54 (block 118) to cause blade 50 to begin feeding balls. After enabling the ball advance, the program provides (block 120) suitable output signals ΔX and ΔY to respective X and Y actuator units 38 and 40 to cause them to aim the gun assembly at a location which is initially (X1, Y1).

In operation of my microballistic printer, if the apparatus is in the quiescent state, blade 50 will have advanced balls to such a position that the leading ball engages the breech 70 so as to form a seal therewith to permit the pressure buildup in pressure chamber 92. From the leading ball counting rearwardly three balls, there will be a ball 14 which is positioned at the rear of seal 80 and which is in engagement with the ball 14 about to emerge from the guide 56.

As the blade 50 rotates, the force of a tooth 52 thereof is exerted on the line of balls 14 between the ball in the breech 70 and the last ball being acted on by the tooth so as to dislodge the ball from the breech. This permits the air in the pressure chamber 92 to expand into the bore 64, expelling the ball 14 therefrom at an exit velocity of from about 20 to about 40 meters per second. After the first ball has been fired, the next ball moves into position in opening 68 to form a seal therewith and the pressure in the chamber 92 again builds up to a value equal to the initial pressure of 4 to 6 atmospheres.

A side conduit 96 forming a T-junction in the air inlet 88 couples the inlet acoustically to a chamber 98 within which I dispose a pressure microphone 100 of any suitable type, such as a piezoelectric microphone, capacitor microphone or the like. The pressure drop occurring in chambers 90 and 92 when the ball 14 is fired propagates a wave along air inlet 88 and conduit 96 to chamber 98, in which it produces a negative-going output from microphone 100. In response to the microphone output, an edge sensor 104 of any suitable type known to the art, such as a differentiator followed by a Schmitt trigger followed by a one-shot multivibrator, supplies computer 42 with a synchronizing pulse. Preferably, air inlet 88 is formed with a constriction 102 on the upstream side of conduit 96 to reduce the rate of pressure drop to a rate readily detectable by microphone 100. To minimize undesirable delay, side conduit 96 and the portion of air inlet 88 connecting conduit 96 to the ball gun 12 should be relatively short.

After aiming the ball gun 12, the subroutine waits (block 122) for a signal from microphone 100 indicating that the ball 14 has been fired. Then subroutine then delays (block 124) for a period sufficient to permit the ball 14 just fired to exit from the ball gun 12. In the ball gun 12 shown, a delay of about 0.3 milliseconds after firing from the breech is sufficient to allow the ball 14 to travel the length of the bore 64. Next, the subroutine tests I to see if it equals N, indicating that N balls have already been fired (block 126). If more balls are to be fired (i.e., I is less than N), the subroutine increments I by one (block 128) and then returns to block 120 to allow the ball gun to be aimed at a new target location. The subroutine continues along the loop comprising blocks 120 to 128, at a rate of up to 2000 times a second or more, as determined by the ball advance rate, until N balls have been fired, at which time the subroutine disables the ball advance motor 54 (block 130) and returns (block 132) to the program that had invoked the subroutine.

Figure 4:
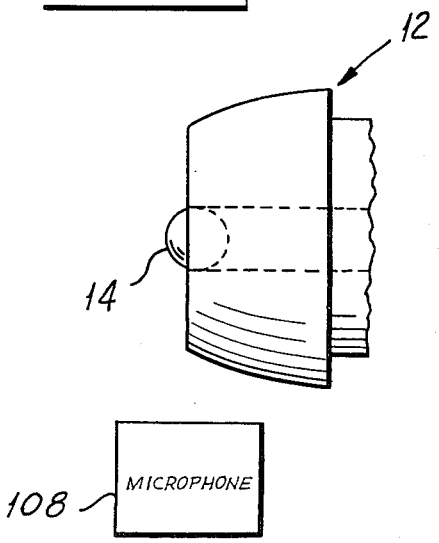
FIG. 4 is a fragmentary elevation of the ball gun of my ballistic printer with an alternative form of firing sensor.
Figure 5:
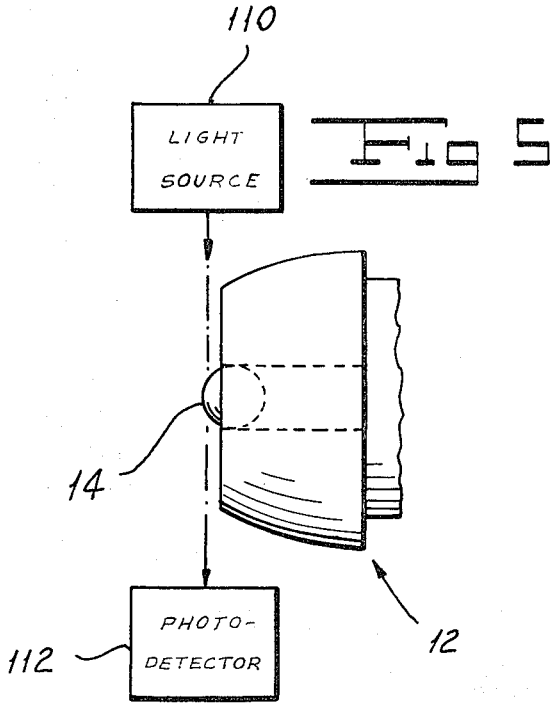
FIG. 5 is a fragmentary elevation of the ball gun of my ballistic printer with another alternative form of firing sensor.

While I have shown a microphone 100 acoustically coupled to the air inlet 88 as the preferred means for fire detection, other means may also be employed. Thus, one may also dispose a microphone 108 adjacent to the exit of the barrel 64, as shown in FIG. 4, to sense the pressure wave created by the expanding air in the barrel when the ball 14 is fully expelled. Alternatively, if desired, one may optically sense the ball 14 as it leaves the barrel 64 by directing a light beam from a source 110 across the path of the exiting ball and sensing the beam by a suitable photodetector 112, as shown in FIG. 5. These alternative means, however, are less desirable than the microphone 100 shown in FIG. 2, since they do not sense the firing of the ball 14 until it has actually left the barrel 64. This inherent delay, coupled with the additional delays inevitably introduced by the external control circuit, limits the maximum firing rate that can be achieved while properly synchronizing aiming and firing.

It should also be noted that, rather than using actuator units 38 and 40 responsive to correction signals $\Delta X$ and $\Delta Y$, one may instead employ servo units having internal control loops which are directly responsive to desired position signals X and Y. Since, in such a case, the control loop is external to computer 42, the computer need only be programmed to supply the basic position signals X and Y rather than correction signals $\Delta X$ and $\Delta Y$.

It will be seen that I have accomplished the objects of my invention. My ballistic printer accurately directs projectiles against a printing medium by precisely synchronizing the aiming and firing of the print projectiles. My ballistic printer is capable of high-speed operation, while at the same time being simple and inexpensive.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. An impact printer for producing an intelligible pattern on a print-receiving medium by successively firing solid projectiles at respective predetermined points on the surface of said medium forming said pattern, including in combination means for supporting said print-receiving medium, a gun having a bore adapted to accept one of said projectiles and a resilient breech so dimensioned relative to said projectile as releasably to hold said projectile, means forming a pressure chamber behind said breech, means for supplying gas under pressure to said chamber, means forming a passage for directing a line of projectiles into said breech, means for exerting positive pressure on said line of projectiles from the rear thereof so as cyclically to introduce a projectile into said breech to form a pneumatic seal permitting an accumulation of pressurized gas in said chamber and then positively urge said projectile through said breech to release said projectile therefrom and permit said pressurized gas to propel said projectile out of said gun toward one of said predetermined points, means for sensing the movement of a first projectile past a predetermined location between said breech and said medium, and means for repositioning said gun to propel a second projectile immediately following said first projectile toward one of said predetermined points, said repositioning means being responsive to said sensing means to reposition said gun only upon sensing of the movement of said first projectile past said predetermined location.

2. An impact printer for producing an intelligible pattern on a print-receiving medium by successively firing solid projectiles at respective predetermined points on said medium forming said pattern, including in combination means for supporting said print-receiving medium, a gun having a bore adapted to accept one of said projectiles and a resilient breech so dimensioned relative to said projectile as releasably to hold said projectile, means forming a pressure chamber behind said breech, means for supplying gas under pressure to said chamber, means for introducing a projectile into said breech to form a pneumatic seal permitting an accumulation of pressurized gas in said chamber and then positively urging said projectile through said breech to release said projectile therefrom and permit said pressurized gas to propel said projectile out of said gun toward one of said predetermined points, means for sensing the movement of a first projectile past a predetermined location between said breech and said medium, and means for repositioning said gun to propel a second projectile immediately following said first projectile toward one of said predetermined points, said repositioning means being responsive to said sensing means to reposition said gun only upon sensing of the movement of said first projectile past said predetermined location.

3. An impact printer for producing an intelligible pattern on a print-receiving medium including in combination means for supporting said medium, means for successively firing solid projectiles toward said medium from a location spaced therefrom, said firing means including means for forming a pressurized region behind a projectile to be fired, said region receiving gas under pressure through a conduit, means for normally restraining said projectile against movement in response to pressure from said region and means for overcoming said restraining means to allow pressure from said region to propel said projectile from said firing means, means for sensing the pressure change occurring at a location along said conduit spaced from said region upon the firing of a first projectile by said firing means, means forming a restriction in said conduit at a point spaced upstream from said location, and means for repositioning said firing means to propel a second projectile immediately following said first projectile toward a predetermined point on said medium forming part of said pattern, said repositioning means being responsive to said sensing means to reposition said firing means only upon sensing of the firing of said first projectile therefrom.

4. An impact printer for producing an intelligible pattern on a print-receiving medium including in combination means for supporting said medium, means for successively firing solid projectiles toward said medium from a location spaced therefrom, said firing means including means for forming a pressurized region behind a projectile to be fired, said region receiving gas under pressure through a conduit, means for normally restraining said projectile against movement in response to pressure from said region and means for overcoming said restraining means to allow pressure from said region to propel said projectile from said firing means, means for sensing the pressure change occurring at a location along said conduit spaced from said region upon the firing of a first projectile by said firing means, and means for repositioning said firing means to propel a second projectile immediately following said first projectile toward a predetermined point on said medium forming part of said pattern, said repositioning means being responsive to said sensing means to reposition said firing means only upon sensing of the firing of said first projectile therefrom.

5. An impact printer for producing an intelligible pattern on a print-receiving medium including in combination means for supporting said medium, means for successively firing solid projectiles toward said medium from a location spaced therefrom, said firing means including means for forming a pressurized region behind a projectile to be fired, means for normally restraining said projectile against movement in response to pressure from said region and means for overcoming said restraining means to allow pressure from said region to propel said projectile from said firing means, means for sensing the pressure change occurring in said region upon the firing of a first projectile by said firing means, and means for repositioning said firing means to propel a second projectile immediately following said first projectile toward a predetermined point on said medium forming part of said pattern, said repositioning means being responsive to said sensing means to reposition said firing means only upon sensing of the firing of said first projectile therefrom.

6. An impact printer for producing an intelligible pattern on a print-receiving medium including in combination means for supporting said medium, means for successively firing solid projectiles toward said medium from a location spaced therefrom, said firing means comprising means forming a bore and means for propelling a projectile along the length of said bore, said propelling means producing a pressure wave upon initiating the propulsion of said projectile along the length of said bore, means for sensing the pressure wave produced upon the firing of a first projectile by said firing means, and means for repositioning said firing means to propel a second projectile immediately following said first projectile toward a predetermined point on said medium forming part of said pattern, said repositioning means being responsive to said sensing means to reposition said firing means only upon sensing of the pressure wave produced upon the firing of said first projectile therefrom.

7. An impact printer for producing an intelligible pattern on a print-receiving medium including in combination means for supporting said medium, a gun for successively firing solid projectiles toward said medium from a location spaced therefrom, said gun having a breech and a bore extending from said breech to a mouth from which said projectiles emerge after being fired from said breech, means for sensing the emergence of a first projectile from said mouth, and means for repositioning said gun to propel a second projectile immediately following said first projectile toward a predetermined point on said medium forming part of said pattern, said repositioning means being responsive to said sensing means to reposition said gun only upon sensing of the emergence of said first projectile from said mouth.

8. An impact printer for producing an intelligible pattern on a print-receiving medium including in combination means for supporting said medium, a gun for successively firing solid projectiles toward said medium from a location spaced therefrom, said gun having a breech and a bore extending from said breech to a mouth from which said projectiles emerge after being fired from said breech, means for sensing the movement of a first projectile from said breech, and means for repositioning said gun to propel a second projectile immediately following said first projectile toward a predetermined point on said medium forming part of said pattern, said repositioning means being responsive to said sensing means to reposition said gun only upon a predetermined time delay following sensing of the movement of said first projectile from said breech sufficient to permit said first projectile to emerge from said mouth.

9. An impact printer for producing an intelligible pattern on a print-receiving medium including in combination means for supporting said medium, a gun for successively firing solid projectiles toward said medium from a location spaced therefrom, said gun having a breech and a bore extending from said breech to a mouth from which said projectiles emerge after being fired from said breech, means for sensing the movement of a first projectile past a predetermined location between said breech and said medium, and means for repositioning said gun to propel a second projectile immediately following said first projectile toward a predetermined point on said medium forming part of said pattern, said repositioning means being responsive to said sensing means to reposition said gun only upon sensing of the movement of said first projectile past said predetermined location.

10. An impact printer for producing an intelligible pattern on a print-receiving medium including in combination means for supporting said medium, means for successively firing solid projectiles toward said medium from a location spaced therefrom, means for sensing the firing of a first projectile by said firing means, means responsive to an aiming signal for repositioning said firing means to propel a second projectile immediately following said first projectile toward a predetermined point on said medium corresponding to said signal, means for producing an aiming signal corresponding to a predetermined point on said medium forming part of said pattern, and means responsive to said sensing means for applying said aiming signal to said repositioning means only upon sensing of the firing of said first projectile from said firing means.

11. An impact printer for producing an intelligible pattern on a print-receiving medium including in combination means for supporting said medium, means for successively firing solid projectiles toward said medium from a location spaced therefrom, means for acoustically sensing the firing of a first projectile by said firing means, and means for repositioning said firing means to propel a second projectile immediately following said first projectile toward a predetermined point on said medium forming part of said pattern, said repositioning means being responsive to said sensing means to reposition said firing means only upon sensing of the firing of said first projectile therefrom.

12. An impact printer for producing an intelligible pattern on a print-receiving medium including in combination means for supporting said medium, means for successively firing solid projectiles toward said medium from a location spaced therefrom, means for optically sensing the firing of a first projectile by said firing means, and means for repositioning said firing means to propel a second projectile immediately following said first projectile toward a predetermined point on said medium forming part of said pattern, said repositioning means being responsive to said sensing means to reposition said firing means only upon sensing of the firing of said first projectile therefrom.

13. An impact printer for producing an intelligible pattern on a print-receiving medium including in combination means for supporting said medium, means for successively firing solid projectiles toward said medium from a location spaced therefrom, means for sensing the firing of a first projectile by said firing means, and means for repositioning said firing means to propel a second projectile immediately following said first projectile toward a predetermined point on said medium forming part of said pattern, said repositioning means being responsive to said sensing means to reposition said firing means only upon sensing of the firing of said first projectile therefrom.

* * * * *